US005841446A

United States Patent [19]

Dai

[11] Patent Number: 5,841,446

[45] Date of Patent: Nov. 24, 1998

[54] METHOD AND APPARATUS FOR ADDRESS MAPPING OF A VIDEO MEMORY USING TILING

[75] Inventor: Dayang Dai, Houston, Tex.

[73] Assignee: Compaq Computer Corp., Houston, Tex.

[21] Appl. No.: 742,881

[22] Filed: Nov. 1, 1996

[51] Int. Cl.[6] ..... G09G 5/00

[52] U.S. Cl. ..... 345/516; 345/515; 345/517; 345/509

[58] Field of Search ..... 345/515, 509, 345/516, 517, 203, 525; 711/200, 202, 203, 206, 209

[56] References Cited

U.S. PATENT DOCUMENTS

| | | | |
|---|---|---|---|
| 3,794,970 | 2/1974 | Pearson et al. | 711/100 |
| 4,386,399 | 5/1983 | Rasala et al. | 711/1 |
| 4,912,658 | 3/1990 | Sfarti et al. | 364/521 |
| 5,129,060 | 7/1992 | Pfeiffer et al. | 395/166 |
| 5,311,211 | 5/1994 | Simpson | 345/189 |
| 5,506,814 | 4/1996 | Hush et al. | 365/230.03 |
| 5,611,029 | 3/1997 | Watters et al. | 395/131 |
| 5,664,161 | 9/1997 | Fukushima et al. | 345/516 |

*Primary Examiner*—Wellington Chin
*Assistant Examiner*—Keith Ferguson
*Attorney, Agent, or Firm*—Vinson & Elkins L.L.P.

[57] ABSTRACT

The present invention is a graphics subsystem with a plurality of storage elements addressed by multiple bit physical addresses and a video display with a plurality of pixels addressed by multiple bit logical addresses. The graphics subsystem includes an address conversion circuitry for converting the logical addresses of the pixels to physical addresses in the video memory. When the number of bytes needed to address the plurality of pixels across the screen is not equal to an integral power of two and the logical addresses of the plurality of pixels are arranged in tiles, the address conversion circuitry converts the logical addresses of the pixels to physical addresses in the video memory by converting only portions of the total address space into tiles at any one time.

20 Claims, 7 Drawing Sheets

| ROW \ COLUMN | 0 | 1 | · · · | 254 | 255 | 256 | 257 | · · · | 510 | 511 | 512 | 513 | · · · | 766 | 767 | 768 | 769 | · · · | 1022 | 1023 |
|---|---|---|---|---|---|---|---|---|---|---|---|---|---|---|---|---|---|---|---|---|
| 0 | 0 | 1 | | 254 | 255 | 256 | 257 | | 510 | 511 | 512 | 513 | | 766 | 767 | 768 | 769 | | 1022 | 1023 |
| 1 | 1024 | 1025 | | 1278 | 1279 | 1280 | 1281 | | 1534 | 1535 | 1536 | 1537 | | 1790 | 1791 | 1792 | 1793 | | 2046 | 2047 |
| 2 | 2048 | 2049 | | 2302 | 2303 | 2304 | 2305 | | 2558 | 2559 | 2560 | 2561 | | 2814 | 2815 | 2816 | 2817 | | 3070 | 3071 |
| 3 | 3072 | 3073 | | 3326 | 3327 | 3328 | 3329 | | 3582 | 3583 | 3584 | 3585 | | 3838 | 3839 | 3840 | 3841 | | 4094 | 4095 |
| 4 | 4096 | 4097 | | 4350 | 4351 | 4352 | 4353 | | 4606 | 4607 | 4608 | 4609 | | 4862 | 4863 | 4864 | 4865 | | 5118 | 5119 |
| 5 | 5120 | 5121 | | 5374 | 5375 | 5376 | 5377 | | 5630 | 5631 | 5632 | 5633 | | 5886 | 5887 | 5888 | 5889 | | 6142 | 6143 |
| 6 | 6144 | 6145 | | 6398 | 6399 | 6400 | 6401 | | 6654 | 6655 | 6656 | 6657 | | 6910 | 6911 | 6912 | 6913 | | 7166 | 7167 |
| 7 | 7168 | 7169 | | 7422 | 7423 | 7424 | 7425 | | 7678 | 7679 | 7680 | 7681 | | 7934 | 7935 | 7936 | 7937 | | 8190 | 8191 |
| 8 | 8192 | 8193 | | 8446 | 8447 | 8448 | 8449 | | 8702 | 8703 | 8704 | 8705 | | 8958 | 8959 | 8960 | 8961 | | 9214 | 9215 |
| 9 | 9216 | 9217 | | 9470 | 9471 | 9472 | 9473 | | 9726 | 9727 | 9728 | 9729 | | 9982 | 9983 | 9984 | 9985 | | 10238 | 10239 |
| 10 | 10240 | 10241 | | 10494 | 10495 | 10496 | 10497 | | 10750 | 10751 | 10752 | 10753 | | 11006 | 11007 | 11008 | 11009 | | 11262 | 11263 |
| ⋮ | | | | | | | | | | | | | | | | | | | | |
| 15 | 15360 | 15361 | | 15614 | 15615 | 15616 | 15617 | | 15870 | 15871 | 15872 | 15873 | | 16126 | 16127 | 16128 | 16129 | | 16382 | 16383 |
| 16 | | | | | | | | | | | | | | | | | | | | |
| ⋮ | ⋮ | | | | | ⋮ | | | | | ⋮ | | | | | ⋮ | | | ⋮ | |
| 767 | | | | | | | | | | | | | | | | | | | | |

*FIG. 1*
*(PRIOR ART)*

2

| ROW \ COLUMN | 0 | 1 | · · · | 254 | 255 | 256 | 257 | · · · | 510 | 511 | 512 | 513 | · · · | 766 | 767 | 768 | 769 | · · · | 1022 | 1023 |
|---|---|---|---|---|---|---|---|---|---|---|---|---|---|---|---|---|---|---|---|---|
| 0 | 0 | 1 | | 254 | 255 | 2048 | 2049 | | 2302 | 2303 | 4096 | 4097 | | 4350 | 4351 | 6144 | 6145 | | 6398 | 6399 |
| 1 | 256 | 257 | | 510 | 511 | 2304 | 2305 | | 2558 | 2559 | 4352 | 4353 | | 4606 | 4607 | 6400 | 6401 | | 6654 | 6655 |
| 2 | 512 | 513 | | 766 | 767 | 2560 | 2561 | | 2814 | 2815 | 4608 | 4609 | | 4862 | 4863 | 6656 | 6657 | | 6910 | 6911 |
| 3 | 768 | | | | | | | | | | | | | | | | | | | |
| 4 | 1024 | | | | | | | | | | | | | | | | | | | |
| 5 | | | | | | | | | | | | | | | | | | | | |
| 6 | | | | | | | | | | | | | | | | | | | | |
| 7 | 1792 | 1793 | | 2046 | 2047 | 3840 | 3841 | | 4094 | 4095 | 5888 | 5889 | | 6142 | 6143 | 7936 | 7937 | | 8190 | 8191 |
| 8 | 8192 | 8193 | | 8446 | 8447 | 10240 | 10241 | | 10494 | 10495 | 12288 | 12289 | | 12542 | 12543 | 14336 | 14337 | | 14590 | 14591 |
| 9 | 8448 | 8449 | | 8702 | 8703 | 10496 | 10497 | | 10750 | 10751 | 12544 | 12545 | | 12798 | 12799 | 14592 | 14593 | | 14846 | 14847 |
| 10 | 8704 | 8705 | | 8958 | 8959 | 10752 | 10753 | | 11006 | 11007 | 12800 | 12801 | | 13054 | 13055 | 14848 | 14849 | | 15102 | 15103 |
| ⋮ | | | | | | | | | | | | | | | | | | | | |
| 15 | 9984 | 9985 | | 10238 | 10239 | 12032 | 12033 | | 12286 | 12287 | 14080 | 14081 | | 14334 | 14335 | 16128 | 16129 | | 16382 | 16383 |
| 16 | | | | | | | | | | | | | | | | | | | | |
| ⋮ | | ⋮ | | | ⋮ | | ⋮ | | | ⋮ | | ⋮ | | | ⋮ | | ⋮ | | | ⋮ |
| 767 | | | | | | | | | | | | | | | | | | | | |

*FIG. 2*
*(PRIOR ART)*

4

| ROW \ COLUMN | 0 | 1 | · · · | 254 | 255 | 256 | 257 | · · · | 510 | 511 | 512 | 513 | · · · | 767 | 768 | · · · | 1023 | 1024 | · · · | 1279 |
|---|---|---|---|---|---|---|---|---|---|---|---|---|---|---|---|---|---|---|---|---|
| 0 | 0 | 1 | | 254 | 255 | 2048 | 2049 | | 2302 | 2303 | 4096 | 4097 | | 4350 | 4351 | | | | | 6399 |
| 1 | 256 | 257 | | 510 | 511 | 2304 | 2305 | | 2558 | 2559 | 4352 | 4353 | | 4606 | 4607 | | | | | 6655 |
| 2 | 512 | 513 | | 766 | 767 | 2560 | 2561 | | 2814 | 2815 | 4608 | 4609 | | 4862 | 4863 | | | | | 6911 |
| 3 | 768 | | | | | | | | | | | | | | | | | | | |
| 4 | 1024 | | | | | | | | | | | | | | | | | | | |
| 5 | 1280 | | | | | | | | | | | | | | | | | | | |
| 6 | 1536 | | | | | | | | | | | | | | | | | | | |
| 7 | 1792 | 1793 | | 2046 | 2047 | 3840 | 3841 | | 4094 | 4095 | 5888 | 5889 | | 6142 | 6143 | | | | | 8191 |
| 8 | 8192 | 8193 | | 8446 | 8447 | 10240 | 10241 | | 10494 | 10495 | 12288 | 12289 | | 12542 | 12543 | | | | | 14591 |
| 9 | 8448 | 8449 | | 8702 | 8703 | 10496 | 10497 | | 10750 | 10751 | 12544 | 12545 | | 12798 | 12799 | | | | | 14847 |
| 10 | 8704 | 8705 | | 8958 | 8959 | 10752 | 10753 | | 11006 | 11007 | 12800 | 12801 | | 13054 | 13055 | | | | | 15103 |
| ⋮ | | | | | | | | | | | | | | | | | | | | |
| 15 | 9984 | 9985 | | 10238 | 10239 | 12032 | 12033 | | 12286 | 12287 | 14080 | 14081 | | 14334 | 14335 | | | | | 16383 |
| 16 | | | | | | | | | | | | | | | | | | | | |
| ⋮ | | ⋮ | | | ⋮ | | ⋮ | | | ⋮ | | ⋮ | | ⋮ | ⋮ | | | | | ⋮ |
| 1023 | | | | | | | | | | | | | | | | | | | | |

*FIG. 3*
*(PRIOR ART)*

6

METHOD AND APPARATUS FOR ADDRESS MAPPING OF A VIDEO MEMORY USING TILING

TECHNICAL FIELD OF THE INVENTION

This invention relates in general to a method and apparatus for address mapping of a memory, and more particularly to the address mapping of a video memory using tiling.

BACKGROUND OF THE INVENTION

In a graphics system, the display is defined by an array of pixels. For example, in a typical Video Graphics Adapter (VGA) system, the screen is addressed as an array of 640×480, 800×600, or 1024×768 pixels. Each pixel on the display may be set to a desired color. The color of each pixel on the screen is stored in a video memory or frame buffer. The colors may be directly specified in the video memory or specified by reference to a palette which stores color information for a predetermined number of colors. Typically palettes are used for color depths of 16 or 256 colors. When larger color depths are used, such as 32 kilobytes or 16.7 megabytes (true color) color depths, each pixel location in the video memory stores data for the Red, Blue, Green (RGB) components of each pixel and may be one or more bytes in length. The number of pixels which may be displayed on the screen is defined by the graphics subsystem. The size of the video memory is dependent upon the resolution and color depth of the display.

The operating environment, such as WINDOWS, must know the capabilities of the graphics subsystem. When the operating environment is loaded, it initiates the loading of a graphics driver, which is a program which acts as an intermediary between the operating environment and accelerated graphics hardware (similarly, application software may have their own drivers to take advantage of acceleration features found in an accelerated video card). The driver passes parameters to the operating environment which specify the accelerated capabilities of the graphics subsystem. Thereafter, when the operating environment (or application) needs to perform a graphics operation which could benefit from one of the accelerated capabilities, it passes the necessary data to the driver. The driver interprets the information from the operating environment, processes the information and passes data via the bus to the graphics subsystem. The graphics subsystem then performs the graphics operation by writing data to its video memory.

Many of today's application programs are graphics intensive. For example, a computer-aided design program, such as AUTOCAD by AutoDesk, Inc., Sauseleto, Calif., may spend a substantial amount of time drawing a figure to the screen. In some cases, even a small change in the drawing will require the entire drawing to be redrawn. In this case, the ability of the graphics subsystem to draw lines quickly and to perform other accelerated functions, such as block transfer of data using a Bit Block Transfer (BLT), becomes of critical importance.

The speed at which a video controller of the graphics subsystem accesses the video memory to write or read the pixel data greatly affects the performance of the graphics subsystem to perform line draws and other accelerated functions. A typical video memory such as a video random access memory (VRAM) is structured in banks having a large number of storage elements. Each storage element is addressable by a physical multiple bit address. The banks of storage elements are usually subdivided into arrays or planes. If there are n rows and m columns in the plane, then the plane has a density equal to n×m. The planes are usually square with m equal to n. Each plane in a bank of video memory is accessed in parallel. Thus, in a memory containing planes, less row and column addresses are required for a total given memory capability since the density of each plane is only a portion of the total memory density and since pixels in the same position in planes of a bank typically respond to the same physical multiple bit logical address.

The dimensions and number of the storage elements in each square plane can be altered to fit a circuit design. One bank of memory may be split into four, eight or sixteen planes depending on the design of the video memory. For example, a bank of VRAM having 1 megabit of memory may be split into four planes for a 256K×4 configuration or into eight planes for a 128K×8 configuration. Due to the design of current graphics controllers, an entire row of storage elements is accessed in a bank in parallel. The amount of memory which is accessed by a video memory at any one time is referred to as a page of video memory. A page of video memory often equals one or two rows of video memory. Thus, it is much quicker for a graphics controller to access various pixels in a row or page of video memory than to access pixels in different pages or rows.

In the prior art, the pixel data for pixels of a screen are stored consecutively in rows of storage elements of a video memory. FIG. 1 is a chart 2 illustrating the mapping of storage elements in a video memory to the pixels on a screen in the prior art. In this example, the screen has a dimension of 1024×768×8. This dimension means that there are 1024 pixels across the screen, 768 rows of pixels and each pixel requires 8 bits of memory. The amount of memory per pixel may vary depending on the color resolution or other information stored for each pixel. Chart 2 shows the row address of pixels of a screen on the left side of the chart and the column address of the pixels of a screen on the top of the chart 2. The individual squares of the chart 2 illustrate the physical address of the storage elements of the video memory corresponding to each pixel. As seen in chart 2, there is a one to one correspondence between the physical addresses of the storage elements and the logical addresses of the pixels. With this prior art mapping, a graphics controller can quickly access a row of the video memory to draw a horizontal line. However, to draw a vertical line or a diagonal line, the graphics controller must access multiple rows. This greatly reduces the speed of drawing. In addition, most of the drawing objects on a screen such as characters, icons, or buttons fit within a relatively small screen area. The application software usually draws these objects in a continuous manner. This requires accessing of multiple rows of video memory.

A method of address mapping used to improve the access time of graphics controllers is called tiling. In tiling, the rows of storage elements in a video memory correspond to blocks or tiles of pixels of a screen rather than to rows of pixels on a screen. FIG. 2 is a chart 12 illustrating the mapping of pixels of a 1024×768×8 screen of FIG. 1 to storage elements in a video memory using tiling. Again, the left side of chart 12 shows the row address of pixels of a screen and the top of chart 12 shows the column address of the pixels of a screen. The individual blocks of the chart show the physical addresses of the storage elements of the video memory. Since each pixel requires one byte of memory in the 1024×768×8 display mode, each physical address of the storage elements addresses one byte of memory. The first "tile" of pixels is mapped to physical addresses 0 to 2047 of the storage elements in the video memory. The storage elements of this first tile are all contained in one or two rows of the video memory depending on the size and configuration of the video memory. Though this decreases the speed of drawing horizontal lines, the speed of access for drawing vertical or diagonal lines is greatly reduced. Rather than having to access a great multitude of rows, only one or two rows of a tile need to be accessed to draw a diagonal or vertical line in that tile. In addition, the drawing of such objects as characters, icons and buttons by the application software is greatly increased because such objects are likely to fit within one tile of the screen.

In order to accomplish tiling, the logical screen addresses must be converted to the new physical addresses of the video memory. If the number of memory bytes necessary to store the pixel information for the pixels across the screen equals an integral power of two, the address conversion is a simple exchange of address bits. For example, the chart 4 in FIG. 2 illustrates a screen in 1024×768×8 display mode, one horizontal line has 1024 pixels, each pixel uses one byte, so $2^{10}$ bytes are required to display one horizontal line. The address conversion is accomplished by switching the eighth and ninth bits of the logical address A8 and A9 with the tenth, eleventh and twelve bits of the logical address A10, A11, A12. This relationship is shown in the equation below wherein :: means concatenation.

Logical Address A20-0

Physical Address A20-13::A9-8::A12-10::A7-0

The address conversion is more complex if the number of memory bytes across a screen is not equal to an integral power of two. For example, many screens today have a width of 1280 pixels. FIG. 3 illustrates a chart 6 illustrating the prior art mapping of pixels of a screen with resolution 1280×1024×8 using tiling. The screen is mapped into rows having five tiles across with each tile having dimensions 256×8 pixels. In the prior art, the conversion of the logical addresses to physical addresses involves long division and/or multiplication. A prior art address conversion for the chart 6 is shown in FIG. 4. The most significant bits A20 through A8 of the logical address 8 are divided by five as shown in block 10 to produce a ten bit quotient and a three bit remainder. The three bit remainder is then switched with the three least significant bits of the ten bit quotient. The least significant bits of the logical address are concatenated to this result to obtain the physical address, as seen in block 12. The division by five of a thirteen bit dividend in this prior art method requires much time and circuitry. In addition, the dividend increases to fourteen or fifteen bits as the size of the logical address space increases to 4 megabytes and 8 megabytes. As a result, the time and complexity of the division operation according to the prior art method will also increase.

Another example of an address conversion is found in U.S. Pat. No. 5,311,211 to Simpson and assigned to Texas Instruments, Inc. As seen in this reference, the address conversion includes multiplication by five of a multiplicand having fourteen bits depending on the size of the video memory.

Accordingly, a need has arisen in the industry for an improved graphics processor which can quickly convert addresses and facilitate the address mapping of the video memory using tiling.

SUMMARY OF THE INVENTION

The present invention is a video subsystem having a video memory including a plurality of storage elements addressed by multiple bit physical addresses; a video display including a plurality of pixels addressed by multiple bit logical addresses, wherein a number of bytes necessary to store information for a plurality of pixels across the screen is not equal to an integral power of two and the logical addresses of the plurality of pixels are arranged in tiles; and an address conversion circuitry for converting the logical addresses of the pixels to physical addresses in the video memory by converting a portion of the logical address space into tiles. The address conversion circuit divides a number of the lower significant bits of the logical address to convert the logical addresses to the physical addresses. The video memory also includes an address look-up table for mapping the portion of the logical address space into tiles equaling a page of memory.

BRIEF DESCRIPTION OF THE DRAWINGS

For a more complete understanding of the present invention, and the advantages thereof, reference is now made to the following descriptions taken in conjunction with the accompanying drawings, in which:

FIG. 1 illustrates a chart of prior art address mapping of logical addresses of pixels on a screen to physical addresses of storage elements in a video memory;

FIG. 2 illustrates a chart of prior art address mapping of logical addresses of pixels on a screen with resolution of 1024×768×8 to physical addresses of storage elements in a video memory using tiling;

FIG. 3 illustrates a chart of prior art address mapping of logical addresses of pixels on a screen with resolution of 1280×1024×8 to physical addresses of storage elements in a video memory using tiling;

DETAILED DESCRIPTION OF THE INVENTION

Figure 4:
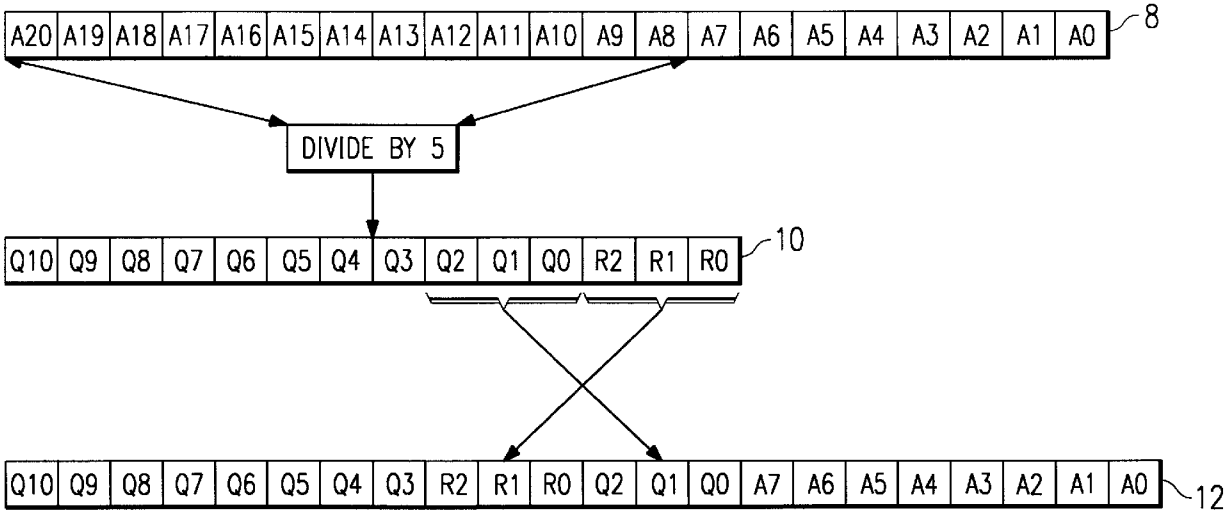
FIG. 4 (PRIOR ART)
FIG. 4 illustrates a block diagram of a prior art address conversion of a screen with resolution of 1280×1024×8.
Figure 5:
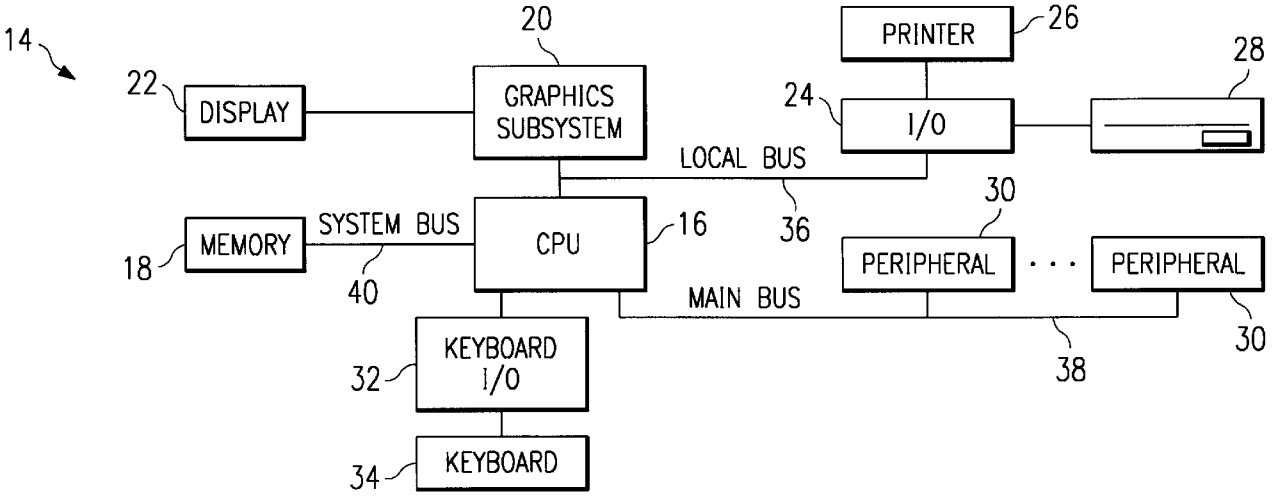
FIG. 5 illustrates a block diagram of a computer system of the preferred embodiment of the present invention.

FIG. 5 illustrates a block diagram of a computer system 14. The computer system 14 includes a microprocessor or central processing unit (CPU) 16, coupled to memory 18 by a system bus 40, a local bus 36 and a main peripheral bus 38. A graphics subsystem 20 and I/O circuitry 24 are coupled to the local bus 36. A display 22 is coupled to the graphics subsystem 20. A hard disk 28 and printer 26 are coupled to the I/O circuitry 24. A plurality of peripherals 30 are coupled to the main bus 38. A keyboard 34 is coupled to the CPU 16 through keyboard interface 32. The computer system 14 of FIG. 5 is an exemplary embodiment for a high performance computer system. Many computer systems vary from the architecture shown in FIG. 5, and the invention described herein would apply to various architectures. Further, the architecture shown in FIG. 5 is a basic architecture and many of the details have been removed for illustrative purposes.

Figure 6:
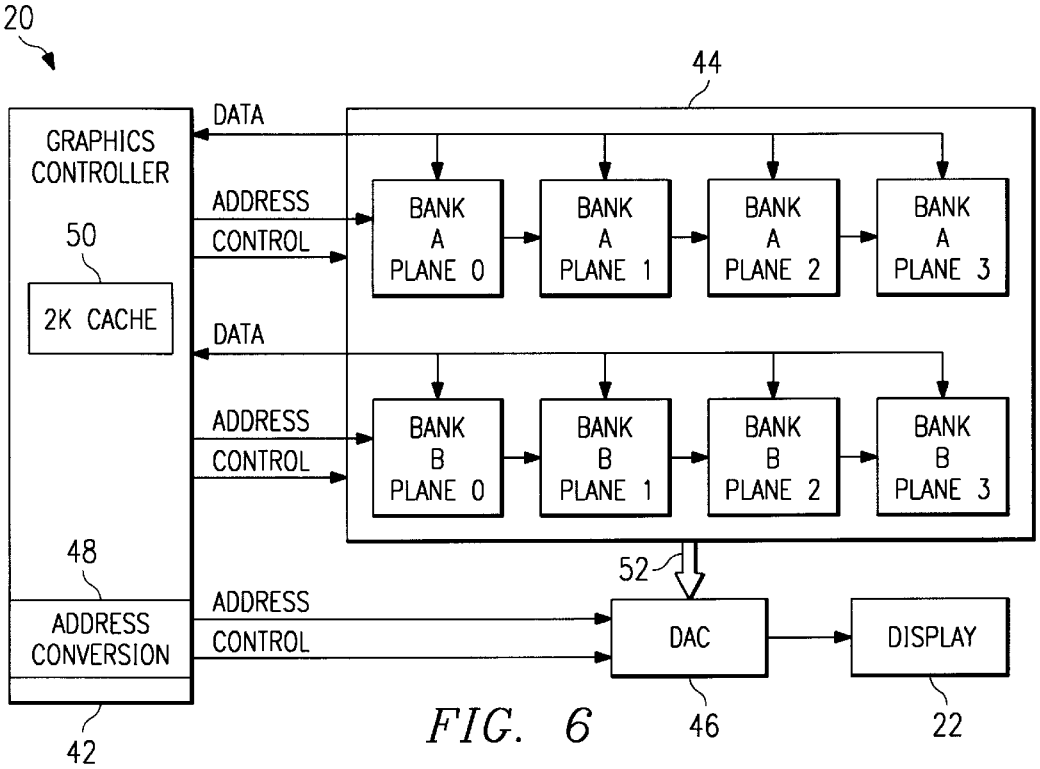
FIG. 6 illustrates a block diagram of a graphics subsystem of the preferred embodiment of the present invention.

FIG. 6 illustrates a block diagram of the preferred embodiment of graphics subsystem 20 in more detail. Graphics subsystem 20 includes a graphics controller 42 connected to a video memory 44 and a digital to analog converter (DAC) 46. Video memory 44 is a video random access memory (VRAM) with a first bank A and a second bank B. Each bank is divided into four planes 0 through 3. Each plane in FIG. 6 is a square array of 512×512 bytes such that a bank contains 1 megabyte of RAM. As a result, a row of each bank is 512×4 or 2 kilobytes of RAM. A page of video memory in this embodiment equals 2 kilobytes of RAM. A person of ordinary skill in the art would appreciate that other types of memory may be used such as DRAM's or SRAM's and that the structure of a video memory may vary. For example, four banks of VRAM may be used or a page of memory may correspond to two or more rows of the video memory. In addition, only one bank may be used that is separated into eight planes.

Graphics controller 42 is connected to video memory 44 by address lines, data lines and control lines. Graphics controller 42 includes a 2K cache 50 and address conversion circuitry 48. Graphics controller 42 is also connected to DAC 46 by address and control lines. DAC 46 is connected to video memory 44 through serial data lines 52 and to display 22. Display 22 may be a raster-scanned cathode ray tube display or a LED display.

In operation, graphics controller 42 reads a page of memory from rows of storage elements in a bank of video memory 44 and stores the pixel data in cache 50. Cache 50 in this embodiment has 2 kilobyte storage space since a page of memory in this embodiment is 2 kilobyte. The cache and page size can be of any size depending on the size of the video memory if the cache is large enough to store a page of video memory.

Graphics controller 42 accesses a page of video memory, stores the page of video memory in cache 50, and manipulates the pixel data as necessary. When it completes its drawing to the page of video memory, graphics controller 42 writes the page of video memory back to video memory 44. Graphics controller 42 controls DAC 46 to serially read pixel data from video memory 44. DAC 46 converts the pixel data to analog RGB signals and outputs the RGB signals to display 22.

Address conversion circuit 48 maps the logical addresses of display 22 to physical addresses of storage elements in video memory 44 using tiling. If the number of memory bytes needed to store pixel information for the pixels in a horizontal line in display 22 is an integral number of two, the address conversion circuit merely switches certain bits in the logical address to generate the final physical address. However, if display 22 has a resolution of 1280×1024×8, the number of memory bytes needed to store pixel information for the pixels across the display 22 is not equal to an integral number of two. In this case, address conversion circuit 48 maps the logical addresses of display 22 as shown in chart 53 of FIG. 7.

The left side of chart 53 shows the row address 0 through 1023 of pixels of a screen and the top of chart 53 shows the column address 0 through 1279 of the pixels of a screen. The individual blocks of the chart illustrate the physical address of the storage elements of the video memory. The screen has a resolution of 1280×1024, and each tile has dimensions of 256×8, resulting in five tiles across the screen. The address conversion circuit 48 invention maps each tile in order that each tile equals a page of video memory. Each tile of the screen in FIG. 7 requires two kilobytes of memory to store the necessary pixel information.

In order to avoid long divisions of thirteen or greater dividends, the address conversion circuit 48 converts only a lower, smaller portion of the logical address space and directly copies the logical address bits which address higher than the smaller portion of the logical address space to obtain the physical address for the video memory. The address conversion circuit 48 performs an exact one to one address re-mapping from the smaller portion of the logical memory space to the resulting physical addresses. The smaller portion of the logical memory is then divided into tiles having a page of memory.

Figure 7:
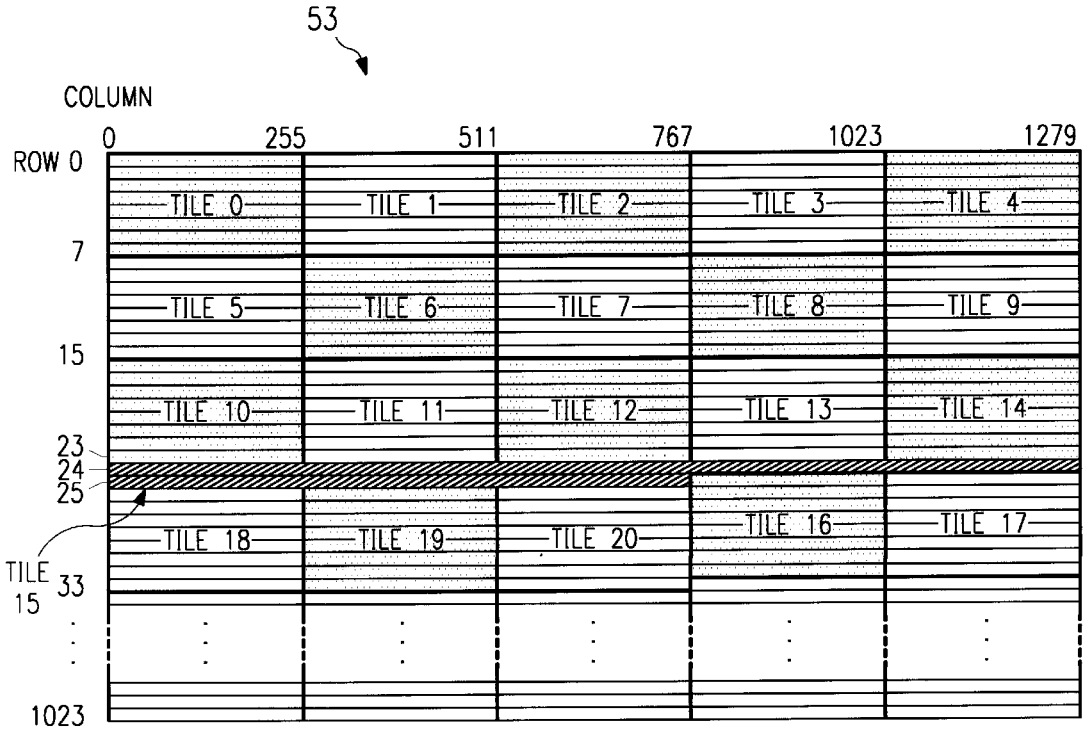
FIG. 7 illustrates a chart of address mapping of logical addresses of pixels on a screen to physical addresses of storage elements in a video memory using tiling according to the preferred embodiment of the present invention.

In the preferred embodiment shown in FIG. 7, the smaller portion of the logical address space is a 32 kilobyte memory space, any logical address in the 32 kilobyte logical address space is remapped to only one physical address within the resulting 32 kilobyte memory space, and the more significant bits are duplicated directly. The 32 kilobyte logical address space is divided into tiles, with each tile equaling a page of memory. Since in this preferred embodiment, a page of memory equal 2 kilobytes, each 32 kilobyte logical address space corresponds to 16 tiles, as seen in FIG. 7.

The size of the dividend can thus be reduced depending on the size of the smaller portion of the logical address space. In the preferred embodiment of a 32 kilobyte portion of the logical address space, only a seven bit dividend is required.

Figure 8:
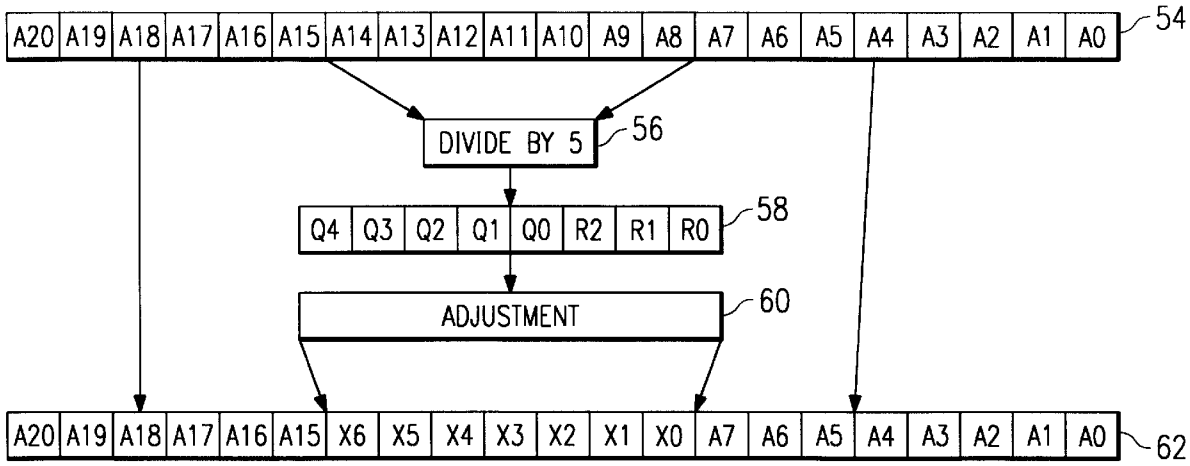
FIG. 8 illustrates a block diagram of an address conversion of the preferred embodiment of the present invention.

FIG. 8 is a block diagram illustrating the method of conversion of the logical addresses of the screen to the physical addresses of the video memory in the preferred embodiment of the present invention. Address bits A20 through A0 in block 54 depict the logical addresses of the pixels on the screen.

The first step of the address conversion shown in block 56 requires that address bits A14 through A8 of the logical address 54 are divided by five. This dividend of seven bits is much shorter than in prior art conversions which required a division of at least thirteen bits for a video memory of two megabytes. The division in the address conversion of the preferred embodiment with only a seven bit dividend greatly reduces the time necessary to complete the address conversion and decreases the amount of hardware. Operating at speeds of up to 60 MHZ, the address conversion circuitry 48 can complete the address conversion in one clock cycle. This performance level was not possible in prior art systems using a dividend of thirteen bits or more using current standard-cell ASIC technology.

Block 58 depicts the result of the division in block 56 which equals a five bit quotient Q4 through Q0 and a three bit integer remainder R2 through R0. The adjustment step shown in block 60 reduces the result of the operation in block 58 to seven bits X6 through X0. The adjustment step of block 60 is explained in more detail below.

The physical address of the video memory generated by the address conversion is shown in block 62. The most significant address bits A20 through A15 are the same as the logical address bits A20 through A15 in block 54. The next seven bits X6 through X0 are the result of the adjustment operation of block 60. The least significant bits A7 through A0 are also the same as the logical address bits A7 through A0 in block 54. Address bits A20 through A15 and X6 through X3 describe the particular tile in which the pixel is located while address bits X2, X1, X0 and A7 through A0 describe the position of the pixel in the tile.

The address conversion of the present invention has further advantages with increased video memory size. In the prior art, the address conversion required division of a thirteen bit dividend if the memory was two megabytes, a fourteen bit dividend if the memory was four megabytes and a fifteen bit dividend for a memory of eight megabytes. In the present invention, the dividend has only seven bits when a smaller portion of the logical space equal to 32 kilobytes is converted, regardless of the memory size. For example, if the memory is four megabytes or eight megabytes additional one or two address bits A22 and A21 are included in the logical address. As with the logical address bits A20 through A15 in FIG. 8, the additional logical address bits A21 and A22 are copied to generate the physical addresses. Thus, any number of additional logical address bits may be included for greater video memory sizes without increasing the size of the dividend from seven bits.

Figure 9:
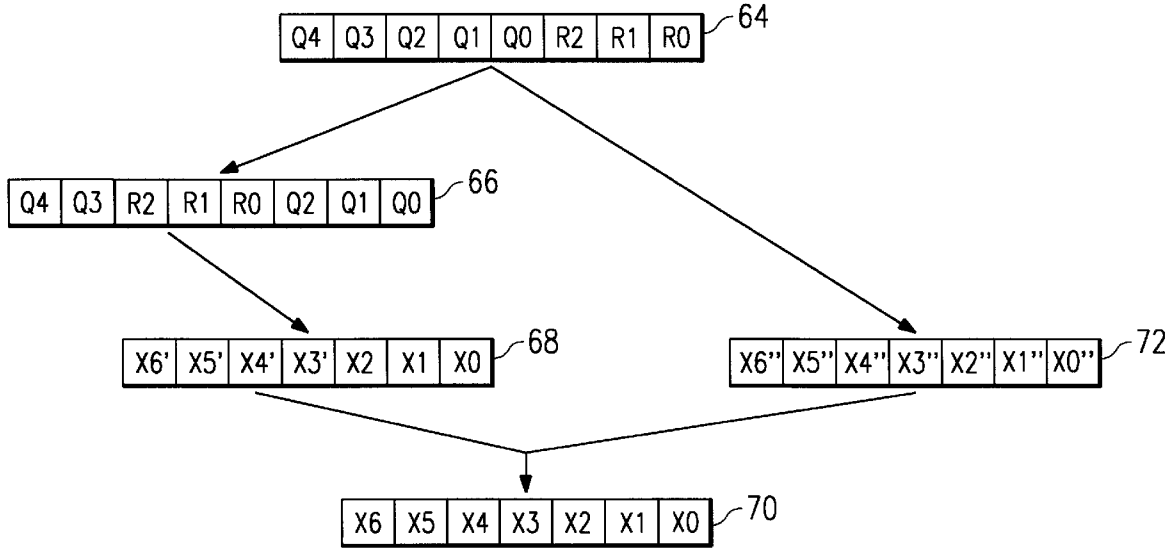
FIG. 9 illustrates a chart depicting the adjustment step in the address conversion of the preferred embodiment of the present invention.

The adjustment step of block 60 in FIG. 8 is now described in more detail with respect to FIG. 9. The adjustment step maps the eight bit quotient and remainder of the division step to the final address bits X6 through X0 according to address look-up tables.

When Q4 through Q0 and R2 through R0 of block 58 are equal to bits 00000-000 through 10111-100, the remainder bits R2 through R0 and two most significant bits Q4 through Q3 should determine the particular tile, and the least significant bits Q2 through Q0 should depict the row within each particular tile. As a result, the remainder bits R2 through R0 are switched with the least significant quotient bits Q2 through Q0, as shown in block 66. These five bits are then mapped to one of fifteen tiles in accordance with Table 1 below.

TABLE 1

Address Look-up Table for Mapping of Quotient and Remainder Bits to Tiles

| Q4 | Q3 | R2 | R1 | R0 | X6' | X5' | X4' | X3' |
|---|---|---|---|---|---|---|---|---|
| 0 | 0 | 0 | 0 | 0 | 0 | 0 | 0 | 0 |
| 0 | 0 | 0 | 0 | 1 | 0 | 0 | 0 | 1 |
| 0 | 0 | 0 | 1 | 0 | 0 | 0 | 1 | 0 |
| 0 | 0 | 0 | 1 | 1 | 0 | 0 | 1 | 1 |
| 0 | 0 | 1 | 0 | 0 | 0 | 1 | 0 | 0 |
| 0 | 1 | 0 | 0 | 0 | 1 | 0 | 0 | 0 |
| 0 | 1 | 0 | 0 | 1 | 1 | 0 | 0 | 1 |
| 0 | 1 | 0 | 1 | 0 | 1 | 0 | 1 | 0 |
| 0 | 1 | 0 | 1 | 1 | 1 | 0 | 1 | 1 |
| 0 | 1 | 1 | 0 | 0 | 1 | 1 | 0 | 0 |
| 1 | 0 | 0 | 0 | 0 | 0 | 1 | 1 | 0 |
| 1 | 0 | 0 | 0 | 1 | 1 | 1 | 0 | 1 |
| 1 | 0 | 0 | 1 | 0 | 1 | 1 | 1 | 0 |
| 1 | 0 | 0 | 1 | 1 | 0 | 1 | 1 | 1 |
| 1 | 0 | 1 | 0 | 0 | 0 | 1 | 0 | 1 |

As seen in Table 1, Q4, Q3 and R2-R0 will have one of fifteen different values. The mapping shown in Table 1 may be performed in any manner as long as there is a one to one correspondence between any Q4, Q3 and R2 through R0 value and a particular tile (corresponding to values 0000 through 1111 if mapping to a pattern of sixteen tiles). In Table 1, the five bits are mapped to tiles 0000 to 1110. The four bit value corresponding to the particular tile from Table 1 replaces Q4, Q3 and R2 through R0 to obtain X6' through X3' while R2 through R0 equal X2 through X1, as seen in block 68 of FIG. 9. These address values correspond to addresses in tiles 0 through 14 shown in FIG. 7.

When Q4 through Q0 and R2 through R0 of block 58 are equal to bits 11000-000 to 11001-010, the adjustment step remaps these bits to a sixteenth tile, shown as tile 15 in FIG. 7. In the prior art mapping shown in FIG. 3, these pixels are allocated to different tiles. In this invention, these pixels need to be grouped into the same tile in order to maintain the one to one mapping. Tile 15 in FIG. 7 includes the remaining logical address space in the 32 kilobyte address space not allocated in the first fifteen tiles 0 through 14. To map these bits to the sixteenth tile, these bits are mapped to X6" through X0" as shown in Table 2 below.

TABLE 2

Address Look-up Table for Mapping of Sixteenth Tile

| | |
|---|---|
| 11 000 000 | 1 111 000 |
| 11 000 001 | 1 111 001 |
| 11 000 010 | 1 111 010 |
| 11 000 011 | 1 111 011 |
| 11 000 100 | 1 111 100 |
| 11 001 000 | 1 111 111 |
| 11 001 001 | 1 111 101 |
| 11 001 010 | 1 111 110 |

The adjustment generates thus X6 through X0 in block 70 from either block 68 or block 72 depending on address look-up Table 1 and Table 2.

The above conversion process results in a screen with five tiles across. A second embodiment of the invention can map addresses of a screen of resolution 1024×768×24 to a format with twelve tiles across the screen, with each tile having a 256×8 pixel size. The number of bytes necessary to store information across the screen is equal to $3\times2^{10}$, which is not an integral power of two. Accordingly, the address conversion requires more than a concatenation of logical address bits.

Figure 10:
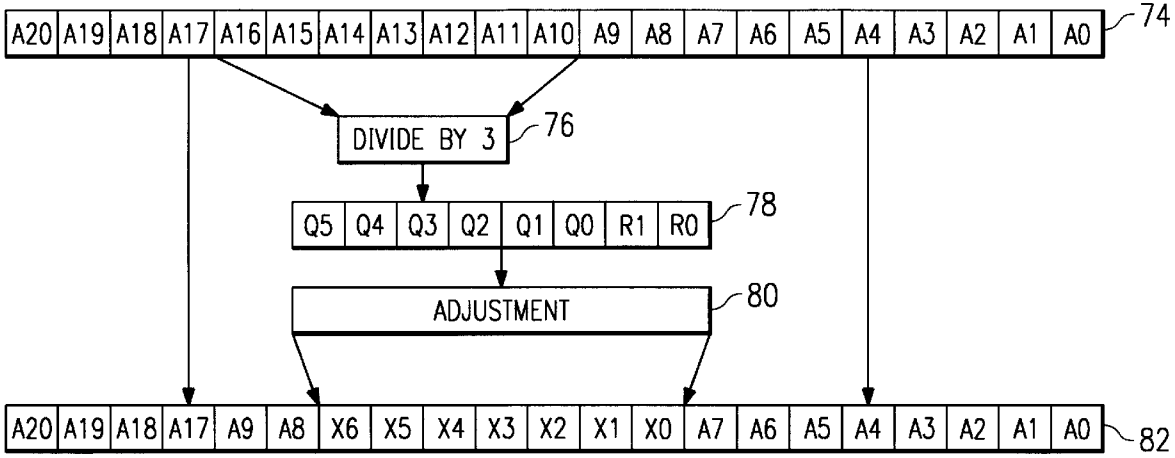
FIG. 10 illustrates a block diagram of an address conversion in a second embodiment of the present invention.

The address conversion process is seen in FIG. 10. Block 74 shows the logical address bits A20 through A0. Logical address bits A16 through A10 are divided by three in block 76 resulting in quotient bits Q5 through Q0 and integer remainder bits R1 and R0 of block 78.

The adjustment step depicted in block 80 reduces the eight bit result to seven bits X6 through X0. The adjustment step includes address look-up tables which have a one to one mapping of quotient remainders to seven bit numbers X6 through X0. The result of the address conversion is depicted in block 82. The first four physical address bits A20 through A17 equal the first four logic address bits A20 through A17. The next two physical address bits correspond to logic address bits A9 and A8 while the next seven physical address bits result from the adjustment step. The last eight bits of the physical address correspond to logic address bits A7 through A0.

Figure 11:
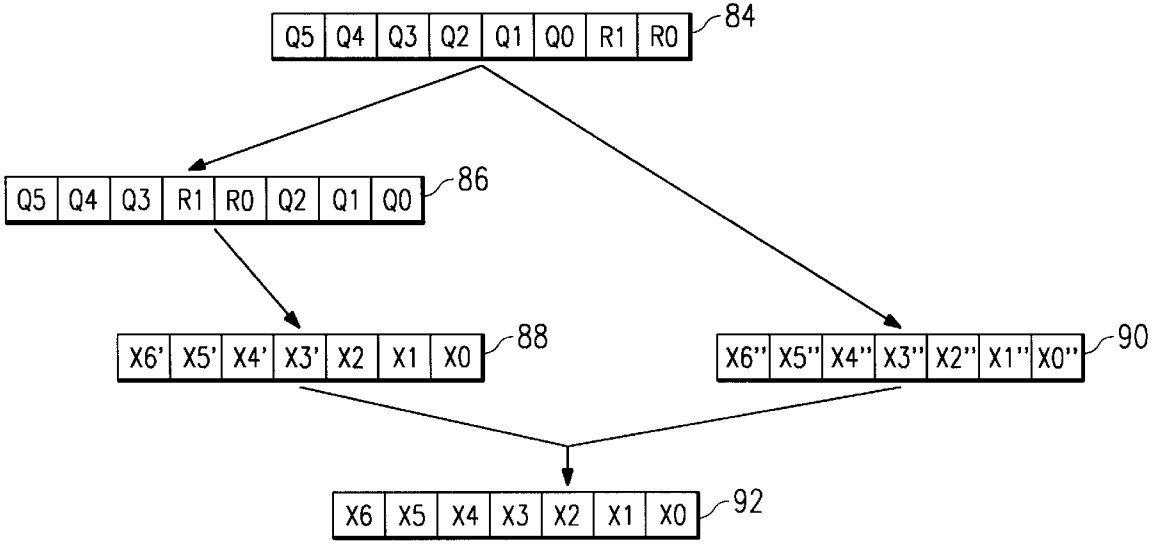
FIG. 11 illustrates a chart depicting the adjustment step in the address conversion of the second embodiment of the present invention.

The adjustment step of block 80 is now described in more detail with respect to FIG. 11. When Q5 through Q0 and R1 through R0 of block 84 in FIG. 11 are equal to bits 000000-00 through 100111-10, the remainder bits R1 through R0 and the three most significant bits Q5 through Q3 should determine the particular tile, and the least significant bits Q2 through Q0 should depict the row within each particular tile. As a result, the remainder bits R1 through R0 are switched with the least significant quotient bits Q2 through Q0, as shown in block 86. These five bits are then mapped to one of fifteen tiles in accordance with Table 3 below.

TABLE 3

Address Look-up Table for Mapping of Quotient and Remainder Bits to Tiles in 1024x768x24 Mode

| Q4 | Q3 | R2 | R1 | R0 | X6' | X5' | X4' | X3' |
|---|---|---|---|---|---|---|---|---|
| 0 | 0 | 0 | 0 | 0 | 0 | 0 | 0 | 0 |
| 0 | 0 | 0 | 0 | 1 | 0 | 1 | 0 | 0 |
| 0 | 0 | 0 | 1 | 0 | 1 | 0 | 0 | 0 |
| 0 | 0 | 1 | 0 | 0 | 0 | 0 | 0 | 1 |
| 0 | 0 | 1 | 0 | 1 | 0 | 1 | 0 | 1 |
| 0 | 0 | 1 | 1 | 0 | 1 | 0 | 0 | 1 |
| 0 | 1 | 0 | 0 | 0 | 0 | 0 | 1 | 0 |
| 0 | 1 | 0 | 0 | 1 | 0 | 1 | 1 | 0 |
| 0 | 1 | 0 | 1 | 0 | 1 | 0 | 1 | 0 |
| 0 | 1 | 1 | 0 | 0 | 0 | 0 | 1 | 1 |
| 0 | 1 | 1 | 0 | 1 | 0 | 1 | 1 | 1 |
| 0 | 1 | 1 | 1 | 0 | 1 | 0 | 1 | 1 |
| 1 | 0 | 0 | 0 | 0 | 1 | 1 | 0 | 0 |
| 1 | 0 | 0 | 0 | 1 | 1 | 1 | 0 | 1 |
| 1 | 0 | 0 | 1 | 0 | 1 | 1 | 1 | 0 |

As seen in Table 3, Q4 through Q3, R1 and R0 will have one of fifteen different values. The mapping shown in Table 3 may be performed in any manner as long as there is one correspondence between any Q4 through Q3, R1 and R0 value and a particular tile (corresponding to values 0000 through 1111). In Table 3, the five bits are mapped to tiles 0000 to 1110. The four bit value from Table 3 replaces Q4, Q3, and R2 through R0 to obtain X6' through X3' while R2 through R0 are copied to X2 through X1, as seen in block 68 of FIG. 9. These address values correspond to addresses in the first fifteen tiles.

When Q4 through Q0 and R2 through R0 of block 58 are equal to bits 101000-00 to 101010-01, the adjustment step remaps these bits to a sixteenth tile. In the prior art mapping shown in FIG. 3, these pixels are allocated to different tiles. This sixteenth tile includes the remaining logical address space in the 32K address space not allocated in the first fifteen tiles 0 through 14. To map these bits to the sixteenth tile, these bits are mapped to X6" through X0" in block 90 of FIG. 11, as shown in Table 4 below.

TABLE 4

Address Look-up Table for mapping of Sixteenth Tile in 1024x768x24 Mode

| | |
|---|---|
| 101000 00 | 1111 000 |
| 101000 01 | 1111 001 |
| 101000 10 | 1111 010 |
| 101001 00 | 1111 100 |
| 101001 01 | 1111 101 |
| 101001 10 | 1111 110 |
| 101010 00 | 1111 011 |
| 101010 01 | 1111 111 |

The adjustment thus generates X6 through X0 in block 92 from either block 88 or block 90 of FIG. 11 depending on address look-up Table 3 and Table 4.

Other configurations of tiles may be used by adjusting the divisor and the adjustment look-up table. The video driver can detect the video modes and determine what value of divisor to use and which adjustment table to use in the address conversion.

CONCLUSION

The present invention is capable of addressing a video memory using tiling addressing. The capability of converting logical address of pixels on the screen to physical address of storage elements in the video memory with tiling increases the speed and efficiency of the line draw engine. The time and hardware necessary to convert the addresses are greatly reduced by the address conversion of the present invention because only a smaller dividend is required in the mathematical operations of the address conversion. In prior art address conversions, large dividends with at least thirteen bits were required for a two megabyte video memory and the size of the dividend increased with increasing size of the video memory. By converting only a smaller portion of the total video memory, the size of the dividend in the address conversion process of the present invention is independent from the size of the video memory. Thus, the address conversion of the present invention provides a greater access time and less hardware for all sizes of video memory.

Although the present invention and its advantages have been described in detail, it should be understood that various changes, substitutions and alterations can be made herein without departing from the spirit and scope of the invention as defined by the appended claims.

What is claimed is:

1. A video subsystem, comprising:

a video memory including a plurality of storage elements addressed by multiple bit physical addresses;

a video display including a plurality of pixels addressed by multiple bit logical addresses, wherein a number of bytes necessary to store information for a plurality of pixels across the screen is not equal to an integral power of two and the logical addresses of the plurality of pixels are arranged in tiles; and address conversion circuitry for converting the logical addresses of the pixels to physical addresses in the video memory by dividing lower significant bits of the logical address to convert the logical addresses to the physical addresses.

2. The video subsystem of claim 1 wherein said lower significant bits of the logical address correspond to bits A14 through A8 of the logical address.

3. The video subsystem of claim 1 wherein the video memory includes an address look-up table for mapping the portion of the logical address space into tiles equaling a page of memory.

4. The video subsystem of claim 1 further including a cache with a memory size equaling at least one page of video memory.

5. The video subsystem of claim 1, wherein the graphics subsystem has a clock speed of 60 megahertz and wherein the address conversion circuit converts a logical address to a physical address within one clock cycle.

6. The video subsystem of claim 1, wherein the logical addresses of the pixels include at least 21 bits A20 through A0 and wherein said address conversion circuitry divides bits A14 through A8 by a divisor to obtain a quotient integer of five bits Q4 through Q0 and a three integer bit remainder R2 through R0.

7. The video subsystem of claim 6, wherein said address conversion circuitry matches the quotient integer Q4 through Q0 and remainder R2 through R0 to a seven bit number X6 through X0 in an address look-up table.

8. The video subsystem of claim 7, wherein the physical address of the storage elements in the video memory has an address of bits A20 through A15 linked to bits X6 through X0 and linked to bits A7 through A0.

9. A computer system comprising:

a processor;

a memory subsystem coupled to said processor;

a video display; and a graphics subsystem, coupled to said processor and said video display, including:

a video memory with a plurality of storage elements addressed by multiple bit physical addresses;

a video display including a plurality of pixels addressed by multiple bit logical addresses, wherein a number of bytes necessary to store information for a plurality of pixels across the screen is not equal to an integral power of two and the logical addresses of the plurality of pixels are arranged in tiles; and address conversion circuitry for converting the logical addresses of the pixels to physical addresses in the video memory by dividing lower significant bits of the logical address to convert the logical addresses to the physical addresses.

10. The computer system of claim 9 wherein said lower significant bits of the logical address correspond to bits A14 through A8 of the logical address.

11. The computer system of claim 9 wherein the video memory includes an address look-up table for mapping the portion of the logical address space into tiles equaling a page of memory.

12. The computer system of claim 9, further including a cache with a memory size equaling at least one page of video memory.

13. The computer system of claim 9, wherein the graphics subsystem has a clock speed of 60 megahertz and wherein the address conversion circuit converts a logical address to a physical address within one clock cycle.

14. A graphics subsystem, comprising:

memory means for storing pixel data in a plurality of storage elements addressed by multiple bit physical addresses;

display means for displaying lines on a screen, wherein the screen includes a plurality of pixels addressed by multiple bit logical addresses arranged in tiles, and wherein the number of bytes necessary to store information for pixels across the screen is not equal to an integral power of two; and address conversion means for dividing less than eight bits of a logical address of a pixel to convert the logical address of the pixel to a physical address in the video memory such that a tile of logical addresses corresponds to a page of video memory.

15. The graphics subsystem of claim 14 wherein the address conversion circuit divides seven bits of the logical address to convert the logical addresses to the physical addresses.

16. The graphics subsystem of claim 15 wherein said seven bits of the logical address correspond to bits A14 through A8 of the logical address.

17. The graphics subsystem of claim 14 wherein the video memory includes an address look-up table for mapping the logical address space into tiles equaling a page of memory.

18. A computer-implemented method of mapping logical addresses of pixels of a video display to a video memory, comprising the steps of:

arranging the logical addresses of the pixels of the video display into a plurality of tiles; and converting the logical address of the pixels of the video display to physical addresses of storage elements in a video memory, such that each one of said plurality of tiles corresponds to a page of video memory, wherein said converting step includes:

dividing less than eight bits of the logical addresses of the pixels; and adjusting a result of the dividing step to correspond to pre-determined values in an address look-up table.

19. The method of claim 18 wherein said dividing step includes dividing seven bits of the logical address to convert the logical addresses to the physical addresses.

20. The method of claim 19 wherein said seven bits of the logical address correspond to bits A14 through A8 of the logical addresses.

* * * * *